United States Patent [19]

Zampini

[11] Patent Number: 4,545,631

[45] Date of Patent: Oct. 8, 1985

[54] OFFSET ELECTRICAL OUTLET

[76] Inventor: William A. Zampini, 21 Water St., Fairport, N.Y. 14450

[21] Appl. No.: 648,258

[22] Filed: Sep. 7, 1984

[51] Int. Cl.[4] ..... H01R 13/00

[52] U.S. Cl. ..... 339/14 R

[58] Field of Search ..... 339/14 R, 14 P, 113 R, 339/184 R, 184 M, 185

[56] References Cited

U.S. PATENT DOCUMENTS 3,975,075 8/1976 Mason ..... 339/14 P

*Primary Examiner*—Joseph H. McGlynn

*Attorney, Agent, or Firm*—Fred L. Denson

[57] ABSTRACT

An improved electrical outlet is described which simultaneously accommodates more than one three prong plug of any shape. The electrical outlet has two receptacles and each receptacle has a pair of contact apertures and a ground aperture for accommodating the corresponding contacts of an electrical plug. The orientation of the pair of contact apertures of one receptacle is offset from the orientation of the other pair of contact apertures of the remaining receptacle by at least 30°. The offset angle caused by the difference in orientations allows space for the use of more than one plug at a time.

2 Claims, 4 Drawing Figures

OFFSET ELECTRICAL OUTLET

BACKGROUND OF THE INVENTION

1. Field of the Invention

The present invention relates to an electrical outlet of the type mounted in a wall outlet box. More particularly, the invention relates to an electrical outlet which is adapted to simultaneously accommodate at the same time two plugs, each having a set of ground and electrical contacts.

2. Description Relative to the Prior Art

Many electrical appliances have a multi-conductor cable attached to an oblong-shaped plug. The cable usually contains two wires for the current and a third wire for grounding the appliance. The conventional plug has three prongs, one for the ground contact and two for the electrical contacts. An oblong-shaped plug is often used to relieve strain which may be caused by bends or twists in the cable where it is attached to the plug. Depending on the configuration of the prongs, the plug is either in a horizontal or vertical position when it is inserted into an outlet with the cable being close and parallel to the face plate of the outlet. With the cable in this position, the likelihood of damage to the cable or accidents is reduced.

Conventional electrical outlets of the type specified above are generally described in U.S. Pat. Nos. 3,688,239 and 2,618,677. The disadvantage of using the type of outlet described in these patents is that in most instances, only one three prong plug can be used at a time even though the outlet contains two receptacles. When attempts are made to use two plugs at the same time, the shape of one plug usually interferes with the insertion of the second plug into the unused receptacle. This problem has been addressed in U.S. Pat. No. 3,975,075. The patentee chose to solve the problem by changing the configuration of the plug. It is, of course, an inconvenience and an expense to change existing plugs to the type described by the patentee.

It is therefore an object of this invention to provide an improved electrical outlet which is suitable for use with conventional three prong plugs.

It is another object of this invention to provide an electrical outlet which is capable of simultaneously accommodating more than one conventional three prong plug at the same time.

These and other objects of the invention are accomplished as set forth in the following summary of the invention.

SUMMARY OF THE INVENTION

In accordance with the present invention, an improved electrical outlet is provided which simultaneously accommodates more than one three prong plug of any shape including conventional oblong-shaped plugs. The electrical outlet has two receptacles and each receptacle has a pair of contact apertures and a ground aperture for accommodating the corresponding contacts of an electrical plug. The orientation of the pair of contact apertures of one receptacle is offset from the orientation of the other pair of contact apertures of the remaining receptacle by at least 30°. The offset angle caused by the difference in orientation provides space for the use of more than one plug at a time since the plugs are accommodated at different angles.

The invention and its objects and advantages will become more apparent by referring to the accompanying drawings and to the ensuing detailed description of the preferred embodiment.

DETAILED DESCRIPTION OF THE PREFERRED EMBODIMENTS

Figure 1:
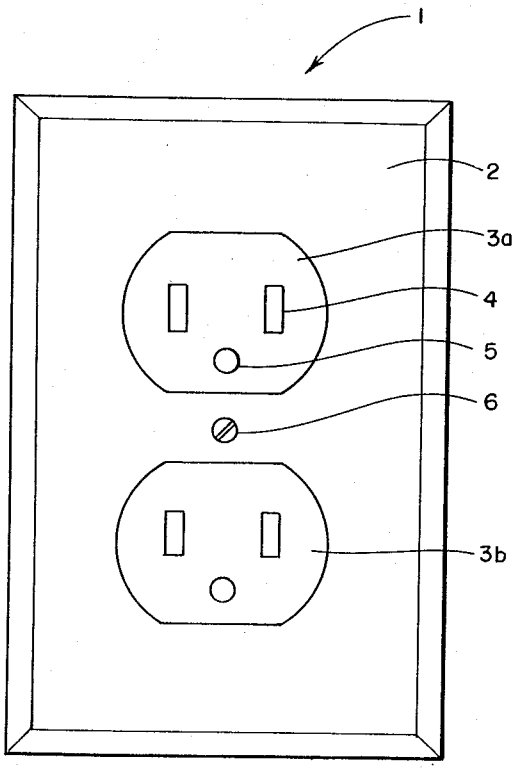
(PRIOR ART) FIG. 1
FIG. 1 is a plan view of a standard electrical outlet.

Referring now to the drawings, FIG. 1 shows a standard electrical outlet 1 which is well known in the prior art. Electrical outlet 1 includes a face plate 2 having two openings for receptacles 3*a* and 3*b*. The face plate 2 is held in place by screw 6. Receptacles 3*a* and 3*b* each include a pair of contact apertures 4 and a ground aperture 5.

Figure 4:
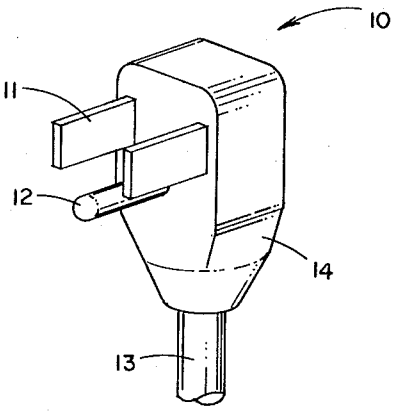
FIG. 4 is a perspective view of a standard electrical plug.

FIG. 4 shows a standard vertical electrical plug 10 for use with electrical outlet 1 of FIG. 1. Electrical plug 10 includes a pair of electrical contacts 11, a ground contact 12 and a multi-conductor cable 13. The oblong shape of plug body 14 serves to relieve the strain on the portion of multi-conductor cable 13 which is connected to plug body 14 thereby diminishing the possibility of cable damage and electrical malfunction.

In the prior art electrical outlet 1 of FIG. 1, the orientation of the contact apertures 4 of receptacle 3*a* is the same as the orientation of contact apertures 4 of receptacle 3*b*. When plug 10 is inserted in one of the receptacles 3*a* or 3*b*, its conductor cable 13 runs parallel to face plate 2. However, because of the orientation of the apertures, and the shape of the plug, there is only enough space to use one plug even though the outlet has two receptacles. Either the conductor or the shape of plug 10 itself interferes with the use of a second plug having a similar shape in the remaining receptacle.

Figure 2:
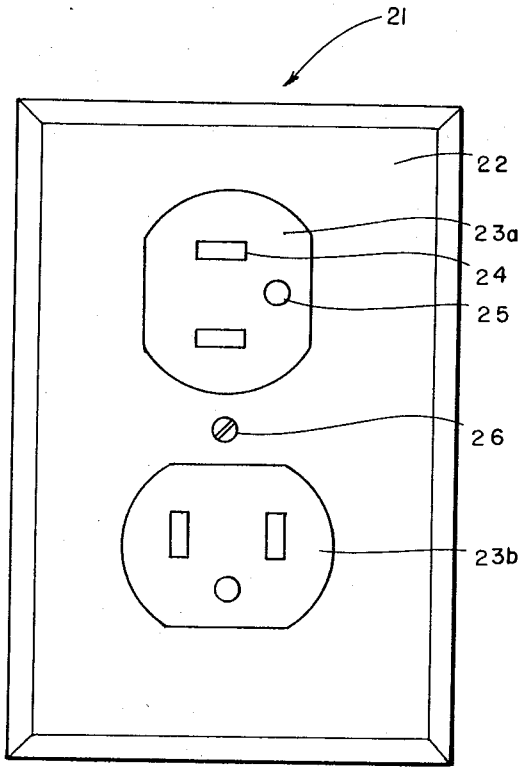
FIG. 2 is a plan view of the electrical outlet of this invention.

The electrical outlet of the present invention as shown in FIG. 2 permits the simultaneous use of two standard oblong plugs with both receptacles of the outlet. While the outlet 21 has the same components as the prior art outlet of FIG. 1, the orientation of the contact apertures 24 of receptacle 23*a* is at a right angle to the orientation of the contact apertures of receptacle 23*b*. The difference in orientation results in an offset angle of 90° which provides sufficient space for a plug to be used in each of receptacles 23*a* and 23*b* at the same time. The openings in face plate 22 are oriented to accommodate the orientation of receptacles 23*a* and 23*b*. Screw 26 secures face plate 22 in place.

Figure 3:
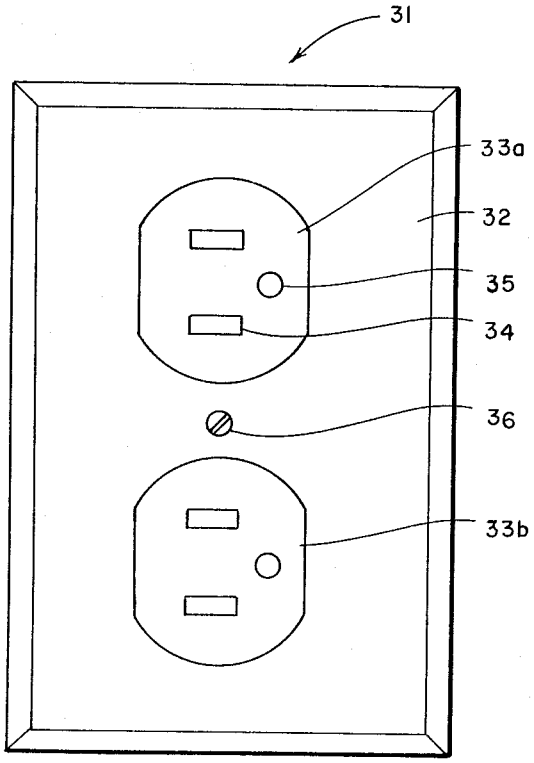
FIG. 3 is a plan view of another type of electrical outlet.

While the discussion thus far has been in reference to a plug of the type shown in FIG. 4, any type of oblong plug may be used with the electrical outlet of this invention. Suitable for use for example, is a horizontal plug (not shown) containing a pair of electrical contacts which are aligned in a direction which is parallel to the direction of the conductor cable and are oriented at 90° compared to the electrical contacts of plug 10. Two plugs of this type may be simultaneously used in both receptacles of the prior art electrical outlet 1 since the electrical cables run in a horizontal direction and do not interfere with each other. However, only one of this type of plug may be used with the type of outlet 31 as shown in FIG. 3. This outlet includes a face plate 32, screw 36, receptacles 33*a* and 33*b*, contact apertures 34 and ground aperture 35. When more than one horizontal plug is used with this type of outlet, the plugs and cables interfere with each other.

Even though two plugs of the type shown in FIG. 4 can be simultaneously used in the receptacles of an outlet of the type shown in FIG. 3, for reasons previously explained, they cannot be simultaneously used with the receptacles of the type of outlet shown in FIG. 1. By orienting the receptacles in accordance with this invention, however, plugs having practically any type of configuration of electrical and ground contacts can simultaneously be used in both receptacles of an electrical outlet. While the orientation of the contact apertures 24 of receptacle 23*a* is shown in FIG. 2 at a right angle to the contact apertures of receptacle 23*b*, any orientation of at least 30° and up to 90° between the two sets of apertures may be used. Thus, the offset angle is preferably not less than 30° nor more than 90°.

The invention has been described in detail with reference to a preferred embodiment thereof, but it will be understood that variations and modifications can be effected within the spirit and scope of the invention. For example, the invention as described herein is applicable to electrical outlets having more than two receptacles.

I claim:

1. An electrical wall outlet comprising:

a first plug receptacle having a pair of contact apertures and a ground aperture designed for accommodating a standard electrical plug and a second plug receptacle having a pair of contact apertures and a ground aperture designed for accommodating a standard electrical plug, wherein the orientation of the pair of contact apertures of the second plug receptacle is offset from the orientation of the pair of contact apertures of the first plug receptacle by at least 30°.

2. The electrical wall outlet of claim 1 wherein the orientation of the pair of contact apertures of the second plug receptacle is offset from the orientation of the pair of contact apertures of the first plug receptacle by 90°.

* * * * *